US005413485A

United States Patent [19]

Adee

[11] Patent Number: 5,413,485

[45] Date of Patent: May 9, 1995

[54] METHOD FOR TEACHING A PERSON TO SWIM

[76] Inventor: Keith Adee, 1705 Whitehall Dr., Apt. 104, Fort Lauderdale, Fla. 33324

[21] Appl. No.: 170,691

[22] Filed: Dec. 21, 1993

[51] Int. Cl.[6] ..... A63B 69/10

[52] U.S. Cl. ..... 434/254; 2/67

[58] Field of Search ..... 2/67, 69, DIG. 3; 441/88, 102, 103, 106, 107, 108, 112, 114, 115, 116, 117, 118, 120; 434/254

[56] References Cited

U.S. PATENT DOCUMENTS

| | | | |
|---|---|---|---|
| 2,329,093 | 9/1943 | Sommers et al. | 2/67 |
| 2,374,506 | 4/1945 | Schorovsky | 2/67 |
| 2,490,556 | 12/1949 | Spack | 441/120 |
| 2,524,212 | 10/1950 | Spack | 441/120 |
| 2,897,821 | 8/1959 | Lerner | 2/67 |
| 2,987,737 | 6/1961 | Brenner | 2/67 |
| 3,023,433 | 3/1962 | Davyso | 441/115 |
| 3,098,248 | 7/1963 | Geier | 441/120 |
| 3,181,184 | 5/1965 | Potts . | |
| 4,291,427 | 9/1981 | Rhea | 441/120 |
| 4,416,641 | 11/1983 | Spinosa et al. . | |
| 4,692,125 | 9/1987 | Wessman . | |
| 5,184,968 | 2/1993 | Michaelochick et al. | 441/118 |

FOREIGN PATENT DOCUMENTS

| | | | |
|---|---|---|---|
| 653195 | 2/1963 | Italy | 441/120 |
| 720039 | 12/1954 | United Kingdom | 441/120 |
| WO8001134 | 6/1980 | WIPO | 2/67 |

*Primary Examiner*—Clifford D. Crowder
*Assistant Examiner*—Gloria Hale
*Attorney, Agent, or Firm*—Heslin & Rothenberg

[57] ABSTRACT

A process for teaching a person how to swim by using a swimsuit having a front portion with a variable buoyancy flotation device that acts to maintain a person in a swimming position, instructing a person how to use proper swimming techniques, and periodically adjusting the buoyancy of the flotation devices to reflect the swimming skills of the pupil. Additionally, an apparatus for practicing the method includes a swimsuit having a front portion covering the chest and abdominal region of a person wearing the swimsuit and one or more compartments in the front portion of the swimsuit to receive flotation devices which act to place the person wearing the swimsuit in a swimming position.

3 Claims, 2 Drawing Sheets

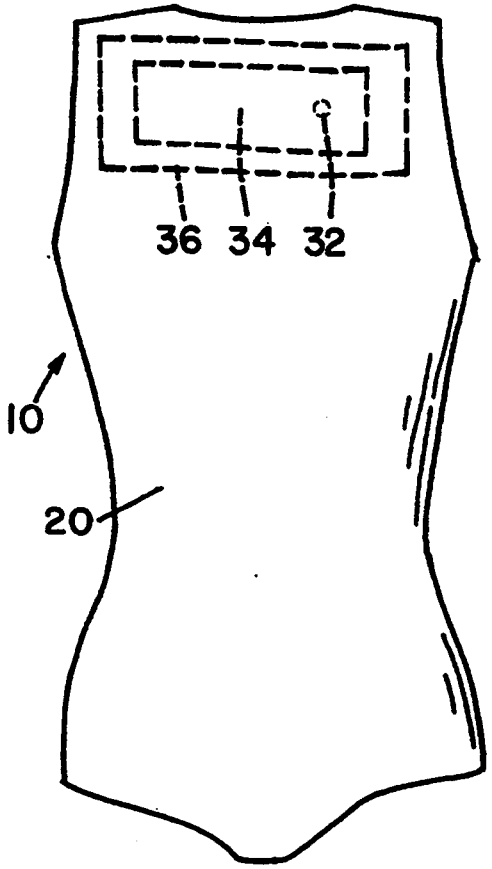
FIG. 3B
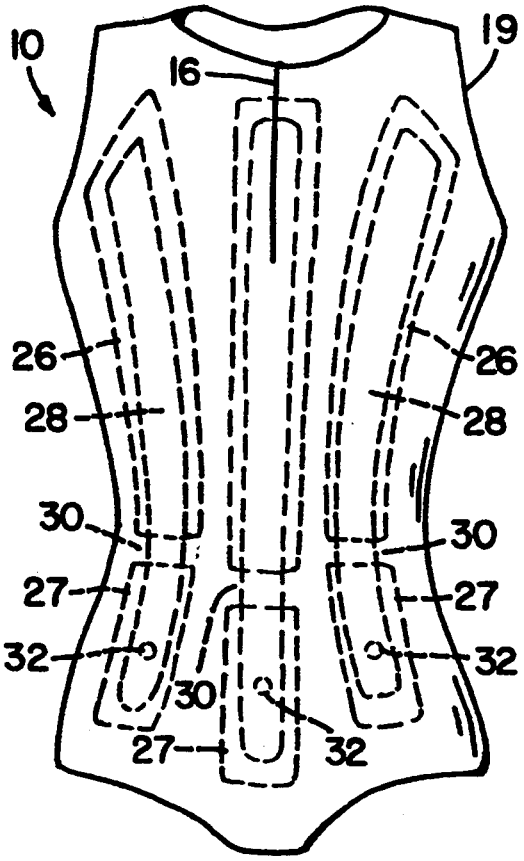
FIG. 3A
FIG. 4
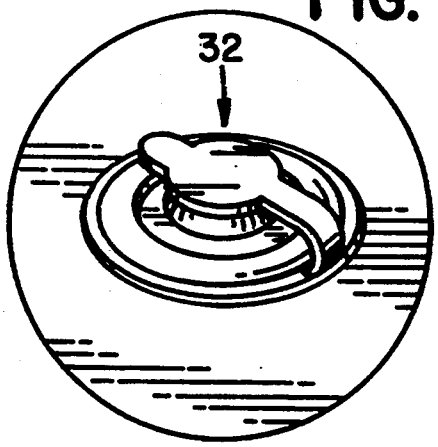
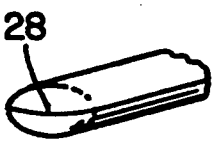
FIG. 6
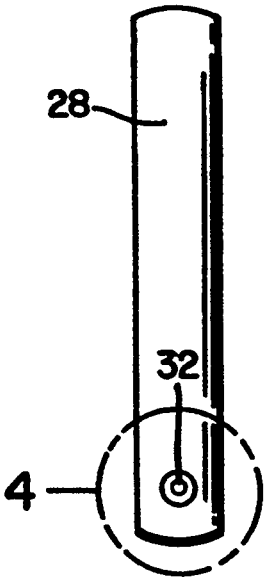
FIG. 5

METHOD FOR TEACHING A PERSON TO SWIM

FIELD OF THE INVENTION

The present invention relates to the field of swimming gear. More particularly, the invention relates to an apparatus and method for safely and efficiently teaching an individual to swim.

BACKGROUND OF THE INVENTION

Today there exist countless numbers of pools, both indoor and out, as well as lakes and other facilities for recreational swimming. Although there exist innumerable recreational facilities for swimming, a significant portion of every community does not know how to swim. A large section of those individuals unable to swim include children. Unfortunately, these circumstances lead to an unnecessarily high number of deaths caused by drowning each year. Therefore, there exists a need for safe and efficient techniques to quickly teach individuals, especially children, how to swim.

It is well known in the art today that there exist life preservers and other flotation devices attachable to an individual which increases their buoyancy and which help prevent drowning. However, all too often these devices fail to address the true problem of teaching children how to swim. Moreover, life preservers restrict the movement necessary for children to learn the proper swimming strokes and techniques. In addition, when such devices are attached to the body by buckles or other fasteners they may easily become undone, either accidentally or purposefully, especially when used by children. Furthermore, when flotation devices are directly attached to an individual they are often exposed and susceptible to puncture or damage during use of the same. Moreover, these devices often fail to deal with the various levels of competency a learning swimmer will experience during their training on how to be a safe and proficient swimmer.

It is therefore an objective of the present invention to provide an apparatus and method for increasing the rate at which an individual can learn how to be a safe and proficient swimmer.

It is also an objective of the present invention to provide an apparatus and method that enhances the buoyancy of swimmers in correlation with the swimmer's level of competency.

SUMMARY OF THE INVENTION

The aforementioned objects are achieved with an apparatus of the present invention comprising a swimsuit having a front portion which covers the chest and abdominal area of the person and a means for receiving one or more flotation devices such that a person wearing the swimsuit is placed into a swimming position. The swimsuit may further comprise flotation devices having variable buoyancy.

The objects are also achieved by performing the following method in accordance with the present invention: placing a person in a swimsuit having a front portion with a variable buoyancy means capable of maintaining an individual in a swimming position, placing the person in the water with their chest facing the water in a swimming position, instructing the person to use proper swimming techniques, repeating these steps and periodically adjusting the buoyancy of the swimsuit until the person is capable of swimming without the buoyancy means.

BRIEF DESCRIPTION OF THE DRAWINGS

FIG. 3A is a front view of the inner portions of the swimsuit shown in FIG. 2.

FIG. 3B is a back view of the inner portions of the swimsuit shown in FIG. 2.

FIG. 4 is an enlarged view of a manual valve located within a flotation device of a swimsuit constructed in accordance with the principles of the present invention.

FIG. 5 is an unrestricted frontal view of a flotation device useable in a swimsuit constructed in accordance with the principles of the present invention.

FIG. 6 is a side view of the section of a flotation device depicted in FIG. 5.

DETAILED DESCRIPTION

The present invention involves both an apparatus in the form of a swimsuit and a method for teaching individuals of various levels of skill how to swim. The swimsuit may include a front portion of the swimsuit having a receiving means, and one or more flotation devices within said receiving means.

Figure 1B:
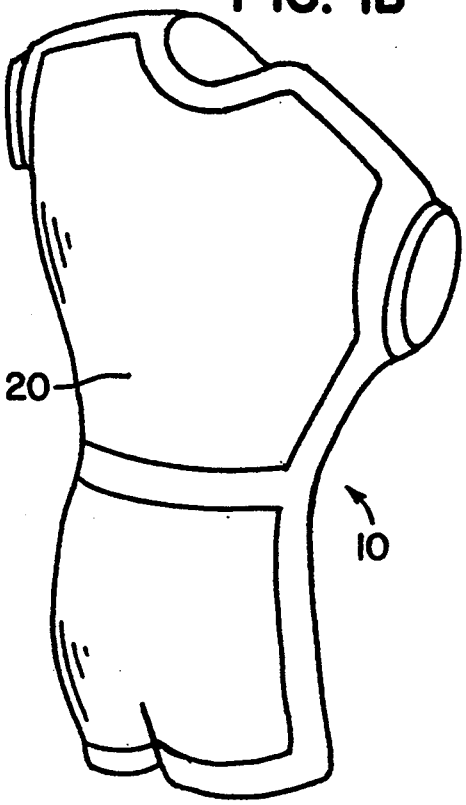
FIG. 1B is a back view of a swimsuit constructed in accordance with the principles of the present invention.
Figure 1A:
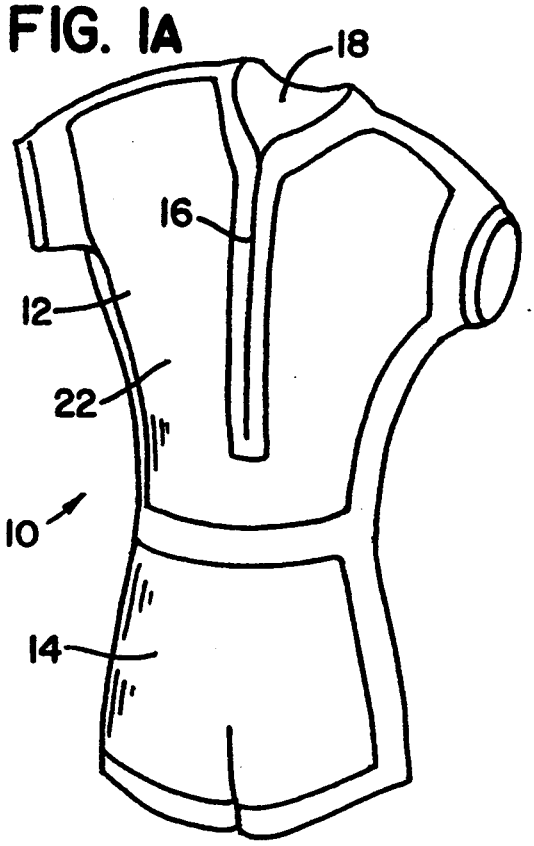
FIG. 1A is a front view of a swimsuit constructed in accordance with the principles of the present invention.
Figure 2B:
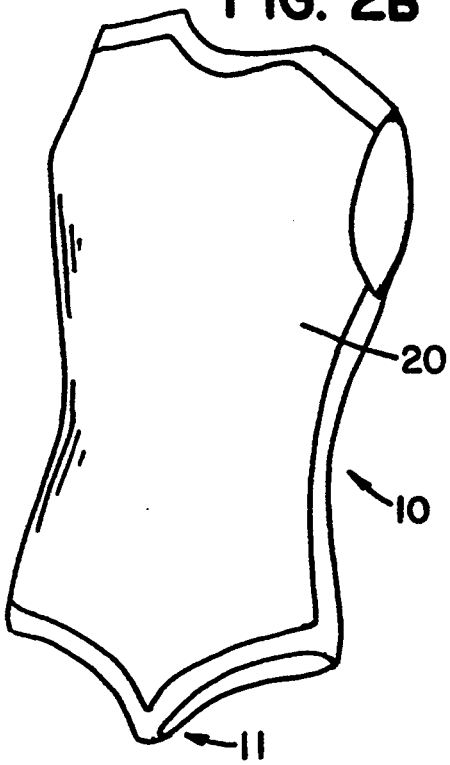
FIG. 2B is a back view of a swimsuit constructed in accordance with the principles of the present invention.
Figure 2A:
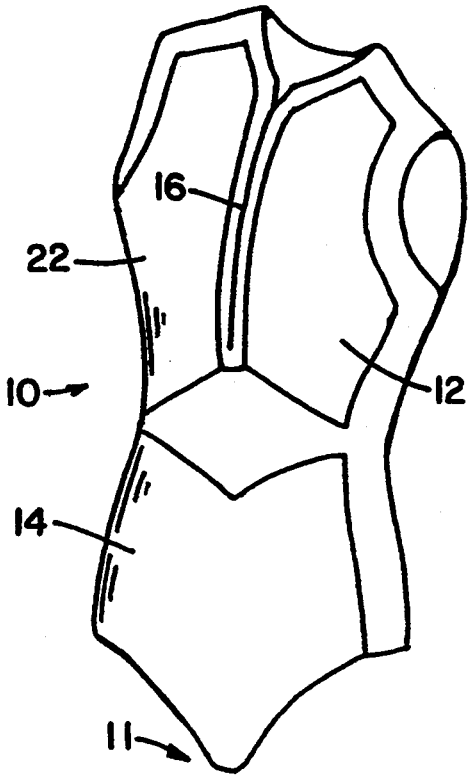
FIG. 2A is a front view of a swimsuit constructed in accordance with the principles of the present invention.

The swimsuit (10) as can be seen in FIGS. 1 and FIGS. 2 is also commonly referred to as a bathing suit, swimming gear, swimming trunks, etc. The swimsuit (10) can be made of plastic as well as almost any material known in the art of swimsuits. However, the swimsuit (10) is preferably made out of Lycra® Spandex® manufactured by DuPont® as this material will stretch in all directions giving the swimsuit the capacity to fit several body sizes with one size swimsuit. The use of Lycra® Spandex® also provides additional advantages which are discussed hereinbelow.

There are countless shapes, sizes and colors that the swimsuit of the present invention can comprise. The size of the swimsuit will be determined by the size of the individual; it should be sized to taughtly fit the individual. Since this swimsuit (10) can be utilized by either children or adults the sizes will vary greatly and may correspond to any of the standard sizes well known in the clothing industry.

The swimsuit (10) should be shaped so that it covers the chest (12) and abdominal (14) area of the individual suited therewith. The shape of the swimsuit, outside of this one requirement, may have numerous forms, thereby conforming to male, female or unisex designs and incorporate various design shapes, colors and alternatives that correspond with the fashion of the times.

Certain designs used in conjunction with an elastic material may not require an opening means to enable an individual to put on and remove the swimsuit (10). However, due to the fact that the swimsuit will cover the chest and abdominal regions of an individual, the design may require a means for getting into and out of the swimsuit. This may be accomplished by using a closable opening (16) within the suit, an example being a closable slit. Any means well known in the swimsuit industry for creating adjustable clothing, some examples being zippers, VELCRO® hook and loop pads buttons and snaps may be used. An example of a closable opening (16) created by a zipper can be seen in FIGS. 1 and 2. It is preferable that the adjusting means be made out of a durable rust proof material such as plastic or the like. If the swimsuit (10) is to be worn by a child, it is also preferable that the adjusting means be situated on the inside (18) of the swimsuit to reduce the child's ability to remove the swimsuit and/or tamper with the flotation devices therein. The front side (22) of the swimsuit should be worn so that it is on the anterior side of the body.

With reference to FIG. 3A, the inner portion of the front side (19) of the swimsuit should have a means for receiving one or more flotation devices (28). However the receiving means could also be located on the outside of the swimsuit. The receiving means may be any one of many methods well known in the clothing industry for holding insulating material or outside articles. The receiving means may comprise a series of one or more pockets, elongated sleeves or sockets attached to the inner portion of the front side (19) of the swimsuit (10). Attaching the receiving means to the inner portion of the swimsuit will help protect the flotation devices placed therein from damage.

Referring to FIG. 3, the receiving means may comprise elongated sleeves (26) and shorter sleeves (27). These sleeves (26, 27) may be made of the same materials as the swimsuit including Lycra® Spandex® since its elasticity will aid in holding the flotation devices (28) in place as well as increase the ease in inserting or adjusting the buoyancy of the flotation devices. The sleeves (26, 27) may be attached to the inner portion (19) of the swimsuit by well known means in the art, some examples being gluing, sewing, hook and loop VELCRO® pads, heat adhesion or buttons, etc. The receiving means should be sized such that the flotation device (28) or a plurality of flotation devices (28) may be placed therein. For example the sleeves (26, 27) should have an opening (30) in which the flotation device (28) can be removably inserted therein. When a plurality of flotation devices (28) are utilized it is preferable that the receiving means comprise multiple sleeves (26, 27) for each flotation device (28) to be inserted therein. As an alternative to having two sleeves 26 and 27 containing one flotation device, one elongated sleeve (not shown) having a single opening, which may be closeable, may contain a single flotation device. The number of flotation devices used, each within a separate sleeve, or set of sleeves 26 and 27, depends upon the size of the swimsuit and the size of the person wearing the suit.

Within the receiving means there is contained one or more flotation devices. Referring to FIG. 3, the flotation devices (28) may comprise of a container of buoyant material sufficient to enable each flotation device within the swimsuit to provide a desired amount of buoyancy. Of course, the buoyancy needed to float an individual may vary with the size of the person and the particular swimsuit (10). The flotation devices (28) may each comprise a hermetically sealed tube of plastic containing air; preferably an elongated tube as can be seen in FIG. 5 and FIG. 6. However any container, preferably flexible, for holding air well known in the art that is impervious to water, durable and light-weight will satisfy the requirements of this invention. Moreover, the flotation devices may comprise buoyant objects other than air containers. For example Styrofoam objects or the like may be used. Preferably, however the buoyancy of the swimsuit should be variable so that if for example Styrofoam objects are used, a plurality of the same may be used so that the buoyancy can be varied by removing a portion of the plurality of Styrofoam objects. Referring to FIGS. 3, 4, 5 and 6, air container flotation devices (28) will have a valve (32) as shown in FIG. 4 allowing manual adjustment of the amount of buoyant material held within the flotation devices (28). Furthermore, it is preferable that the valve (32) be located upon the flotation device such that it is readily accessible from the openings (30) within the receiving means. This will allow adjusting the overall buoyancy of the swimsuit without requiring removal of one or more of the flotation devices (28). The sleeves and flotation devices placed therein are located on the front portion of the swimsuit so that they cover a portion of the chest and abdominal region of the person wearing the suit to place such person in the swimming position. The swimming position is a horizontal position floating on the water surface with the abdomen facing the water.

In addition, an alternative embodiment of the invention may contain additional flotation devices in relation to the back (20) of the swimsuit (10) as can be seen in FIG. 7. A flotation device (34) may be positioned on the upper part of swimsuit (10) near the shoulders so that if an individual is turned onto their back the head may be supported above water. The flotation device (34) may be held in place by a receiving means such as a sleeve (36), attached to the back inner portion (21) of swimsuit (10). The receiving means should be placed so that the flotation device (34) is lodged just below the base of the neck. The receiving means and flotation device (34) can be of the same construction and materials as receiving means and flotation devices discussed above. However, it is preferable that here a single flotation device is utilized of rectangular shape.

A further embodiment of this device may include a VELCRO® hook and loop closure the bottom swimsuit (11) so that diapers may be changed without requiring removal of the swimsuit (10).

In addition to the apparatus, the present invention comprises a process for teaching a person to swim. The process includes placing a swimsuit as described above on a person, placing the suited person in the water with their chest facing the water in a swimming position, instructing the person to use proper swimming techniques so that the person uses swimming techniques to attempt to swim.

One may begin the present method by partially filling the flotation devices (28) with air so that they are stiff enough to be inserted into the receiving means (26) and inserting the flotation devices (28) into the respective receiving means (26). Preferably the flotation devices (28) are inserted such that the valves (32) are readily accessible to the openings (30) in the receiving means (26). After the flotation devices (28) have been inserted they may be fully inflated or inflated to create the desired degree of buoyancy.

Once the swimsuit is inflated to the desired buoyancy it can then be placed on the individual to be taught. Thereafter the suited individual is immersed in the water such that the front side of the person as well as the front side of the swimsuit (22) is facing the water. This will place the individual in a position substantially horizontal, i.e., a swimming position. If the individual to be taught is a small child then they should preferably be physically placed, using both hands, on their stomachs in the water. While holding the pupil in the swimming position they may be moved around in the water. While moving the pupil in this position instruct them simultaneously on how to make the proper swimming strokes or on how to safely float. The pupil should then attempt to swim. Gradually the support provided by the instructor should be reduced until the pupil can sufficiently swim or float solely with the aid of the swimsuit.

Once they have adequately learned the proper swimming motions and techniques with the aid of the swimsuit at a particular buoyancy, the buoyancy of the swimsuit (10) may be reduced. Preferably this is done in between teaching sessions. The air within the flotation devices (28) may be reduced by approximately 25%, however, the amount of air to be released will depend upon the skill of the pupil as well as their confidence. The more air released the less buoyant the swimsuit (10). Therefore, less air should be released for pupils with little confidence and limited swimming skills.

After one or more sessions it may be preferable to have the pupil progressively start the session with less and less initial contact or help from the instructor in entering the pool or beginning to swim. Thereafter, the steps from above are repeated until the pupil has become a safe and proficient swimmer. Depending on the age of the pupil, the rate at which they learn, their skill and confidence as few as one or numerous sessions can be used to teach the pupil to swim.

Although the invention has been disclosed in relation to the embodiments herein, it is apparent that various modifications, substitutions, equivalents and other changes may be utilized without departing from the spirit of the invention. Any such modifications are intended to be within the scope of the invention as defined by the following claims.

What is claimed is:

1. A process for teaching a person to swim comprising:

(a) placing a swimsuit having a front portion with a variable buoyancy means thereon on a person wherein said person is maintained in a swimming position;

(b) placing said person in water with their chest facing the water in a swimming position;

(c) instructing the person to use proper swimming techniques and strokes wherein the person attempts to swim;

(d) repeating steps a), b) and c) and periodically after step c) adjusting the buoyancy using said variable buoyancy means to reflect the swimming skills of said person until the person is capable of swimming without using said buoyancy means.

2. The process of claim 1 wherein said variable buoyancy means comprises a plurality of sleeves and flotation devices insertable within said sleeves.

3. The process of claim 2 wherein said valuable buoyancy means comprises one or more compartments having one or more air cylinders with a manual valve therein for selectively adjusting the air pressure within each of said cylinders.

* * * * *